US010714250B2

(12) United States Patent
Maisch et al.

(10) Patent No.: US 10,714,250 B2
(45) Date of Patent: Jul. 14, 2020

(54) ELECTROMAGNETIC ACTUATOR

(71) Applicant: ECO Holding 1 GmbH, Marktheidenfeld (DE)

(72) Inventors: Dieter Maisch, Kohlberg (DE); Bernhard Schatz, Ostfildern (DE); Hartmut Weber, Altdorf (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 251 days.

(21) Appl. No.: 15/422,673

(22) Filed: Feb. 2, 2017

(65) Prior Publication Data

US 2017/0178779 A1 Jun. 22, 2017

Related U.S. Application Data

(63) Continuation of application No. PCT/EP2015/069826, filed on Aug. 31, 2015.

(30) Foreign Application Priority Data

| | | |
|---|---|---|
| Sep. 11, 2014 | (DE) | 10 2014 013 191 |
| Nov. 14, 2014 | (DE) | 10 2014 116 661 |
| Aug. 24, 2015 | (DE) | 10 2015 113 970 |

(51) Int. Cl.
*H01F 7/16* (2006.01)
*F01L 13/00* (2006.01)

(52) U.S. Cl.
CPC ..... *H01F 7/1615* (2013.01); *F01L 13/0036* (2013.01); *H01F 7/1646* (2013.01); *F01L 2013/0052* (2013.01); *F01L 2820/031* (2013.01)

(58) Field of Classification Search
CPC ..... H01F 7/1615; H01F 7/1646; F01L 2013/0052
USPC ..... 335/232–234
See application file for complete search history.

(56) References Cited

U.S. PATENT DOCUMENTS

| | | | | |
|---|---|---|---|---|
| 8,339,225 | B2 * | 12/2012 | Nendel | F01L 1/047 123/90.11 |
| 8,474,424 | B2 * | 7/2013 | Meintschel | F01L 13/0036 123/90.18 |
| 8,997,702 | B2 * | 4/2015 | Popp | F16H 21/44 123/90.11 |
| 9,245,697 | B2 * | 1/2016 | Houbre | H01H 71/2454 |
| 2004/0201441 | A1 * | 10/2004 | Elendt | F01L 13/0036 335/179 |

(Continued)

FOREIGN PATENT DOCUMENTS

| | | |
|---|---|---|
| DE | 102007028600 B4 | 12/2008 |
| DE | 102009015846 A1 | 10/2009 |

(Continued)

*Primary Examiner* — Alexander Talpalatski
(74) *Attorney, Agent, or Firm* — Von Rohrscheldt Patents

(57) ABSTRACT

An electromagnetic actuator including an actuator unit; and an actuation unit acting in an axial direction, wherein the actuator unit includes a coil generating a magnetic field and including a pole core that is arranged within the coil, wherein at least two permanent magnets are arranged adjoining a face of the pole core in the axial direction so that the at least two permanent magnets are applicable to the face of the pole core and movable in the axial direction so that the at least two permanent magnets are drivable by the coil independently from each other.

12 Claims, 4 Drawing Sheets

(56) References Cited

U.S. PATENT DOCUMENTS

| | | | | |
|---|---|---|---|---|
| 2007/0171016 | A1* | 7/2007 | Bonjean | H01F 7/1615 335/234 |
| 2008/0164964 | A1* | 7/2008 | Nelson | H01F 7/1646 335/229 |
| 2010/0237264 | A1* | 9/2010 | Lengfeld | F01L 13/0036 251/89 |
| 2012/0235777 | A1* | 9/2012 | Elendt | F01L 13/0036 335/229 |
| 2015/0322830 | A1* | 11/2015 | Rigling | F01L 13/0036 123/90.11 |

FOREIGN PATENT DOCUMENTS

| | | | |
|---|---|---|---|
| DE | 102009015466 | | 3/2010 |
| DE | 102009006061 | A1 | 7/2010 |
| DE | 102009015486 | | 9/2010 |
| DE | 202009006940 | U1 | 9/2010 |
| DE | 102010024030 | A1 | 12/2011 |
| DE | 102011009327 | A1 | 7/2012 |
| WO | WO2014086345 | A1 | 6/2014 |

* cited by examiner

ELECTROMAGNETIC ACTUATOR

RELATED APPLICATIONS

This is a continuation of International Application PCT/EP2015/069826 filed on Aug. 31, 2015 claiming priority from German Patent Applications DE 10 2014 013 191.2 filed on Sep. 11, 2014, DE 10 2014 116 661.2 filed on Nov. 14, 2014, and DE 10 2015 113 970.7 filed on Aug. 24, 2015, all of which are incorporated in their entirety by this reference.

FIELD OF THE INVENTION

The invention relates to an electromagnetic actuator, in particular for actuating applications at an internal combustion engine of a motor vehicle.

BACKGROUND OF THE INVENTION

Due to space constraints at an application location there is a long felt need to implement an actuator with a plurality of typically selectively and independently controllable plunger units for a respective actuation task with sufficiently compact outer dimensions. This provides on the one hand side sufficient electromagnetic functionality, thus with respect to a required actuation stroke of the plunger units and reaction time or switching time, on the other hand side there is no undesirable mutual mechanical or electromagnetic interference.

It is known in the art to implement actuation functions which require a plurality of actuator units using individual actuator units that are attached or provided independently from each other which typically causes increased configuration or assembly complexity and typically puts limits on the compactness of the entire arrangement.

This problem is aggravated in that the application which requires an engagement of a plurality of plunger units defines that the plunger units have to be closely adjacent to each other and typically may only have a predetermined maximum distance from each other. This, however is typically not solvable with individually attached actuator units or only solve able with limitations.

DE 10 2007 028 600 B4 discloses an electromagnetic actuator where a plurality of for example three actuator units with three corresponding plunger units is provided in a common hollow cylindrical housing. Thus, driving the elongated cylindrical plunger units is provided in that the plunger units contact an engagement surface of a respective associated actuator unit and for example adhere thereto through a magnet effect. Thus, the engagement surface typically forms the distal end of an armature of the respective actuator unit.

Thus, for engagement surfaces of adjacent actuator units which engagement surfaces are driven parallel to each other respective plunger units contact the engagement surfaces of the plunger units with engaging faces of the plunger units in an eccentrical manner which provides a compact arrangement of the plunger units that are run with parallel axes and therefore minimum axial distances of the plunger units from each other can be implemented under the predetermined actuation and installation conditions.

It is a disadvantage of this solution that the eccentrical force impact leads to tilt moments which lead to increased friction and wear and which have to be received by an additional component. Furthermore an actuator is required for actuating each plunger. Actuating the plungers simultaneously unintentionally could lead to an accident.

DE 10 2009 015 486 A1 furthermore discloses to an electromagnetic actuator where a permanent magnet is associated with each actuator pin, wherein the permanent magnets are oriented with opposite polarities and a magnet coil device generates a magnet field through electrical polarity reversal which changes directions with electrical current reversal. Also here force introduction into the actuator pins is performed in an eccentrical manner due to the small installation space.

DE 10 2011 009 327 A1 describes an electromagnetic actuator with eccentrical force application. Permanent magnets are thus associated with a respective pole element.

DE 10 2009 006 061 A1 furthermore discloses an actuator arrangement with two actuators. The actuators are configured as a double actuator respectively including an armature unit and a stator unit. The armature units respective include an actuation pin which is actuatable by spring devices in addition to the magnetic force. Permanent magnets connect the actuation pins with centering elements through a magnetic force.

BRIEF SUMMARY OF THE INVENTION

Thus, it is an object of the invention to provide an electromagnetic actuator with a plurality of actuator elements wherein the electromagnetic actuator can be produced in a cost effective manner and with robust features in a compact configuration with a small lateral distance of the actuation elements.

According to an aspect of the invention the object is achieved by an electromagnetic actuator including an actuator unit; and an actuation unit acting in an axial direction, wherein the actuator unit includes a coil generating a magnetic field and including a pole core that is arranged within the coil, wherein at least two permanent magnets are arranged adjoining a face of the pole core in the axial direction so that the at least two permanent magnets are applicable to the face of the pole core and movable in the axial direction so that the at least two permanent magnets are drivable by the coil independently from each other, wherein the at least two permanent magnets have different polarity in the axial direction and are respectively controllable by loading the coil with an electrical current so that at least one of the at least two permanent magnets moves in the axial direction in an opposite direction to another of the at least two permanent magnets when the coil is loaded with the electrical current, wherein the actuation unit is arranged in the axial direction adjacent to the actuator unit wherein the actuation unit includes at least two actuation elements which are actuatable in the axial direction wherein each actuation element of the actuation unit is respectively associated with one of the at least two permanent magnets and moved by the one permanent magnet in the axial direction, wherein the actuator unit and the actuation unit are arranged in a common housing of the electromagnetic actuator, wherein the at least two actuation elements and the at least two permanent magnets are arranged so that each respective permanent magnet of the at least two permanent magnets is arranged concentrically relative to a respective actuation element of the at least two actuation elements so that a force impact from the at least two permanent magnets upon the at least two actuation elements is provided in a centric manner relative to the respective actuation element, and wherein the at least two actuation elements are rotatably arranged in the housing.

Advantageous embodiments and advantages of the invention can be derived from the dependent claims, the description and the drawing figures.

An electromagnetic actuator is proposed including an actuator unit and an actuation unit acting in an axial direction wherein the actuator unit includes a coil generating a magnetic field and a pole core arranged with in the coil. At least two permanent magnets are arranged adjacent to a face of the pole core in an axial direction so that they are applicable to the face of the pole core and movable in the axial direction wherein the permanent magnets are drivable by the coil independently from each other. Furthermore the permanent magnets have different polarity in the axial direction and are respectively controllable by loading the coil with current so that current loading the coil moves at least one of two or more permanent magnets in the axial direction opposite to the other permanent magnets. The actuation unit is arranged in an axial direction adjacent to the actuator unit wherein the actuation unit includes at least two actuation elements which are actuatable in the axial direction. Thus, each actuation element of the actuation unit is respectively associated with one of the permanent magnets and actuated by the permanent magnet in the axial direction. The actuator unit and the actuation unit are arranged in a common housing of the actuator.

According to the invention the actuation elements and the respective permanent magnet are arranged concentrically so that a force impact upon the actuation elements which are arranged in the housing in a rotate able manner is provided in a concentric manner. Thus, eccentrical loading and associated wear are excluded without having to forego an installation space optimized actuator and a minimum axis distance of the actuation elements. Expensive support measures can thus be omitted.

Since the actuation elements are configured rotatable wear, for example during rolling in engagement grooves can be minimized.

The electromagnetic actuator according to the invention includes a plurality of permanent magnets which can be used in particular also at installation locations with limited installation space and in particular in systems with a small distance of the actuation elements.

The electromagnetic actuator includes a coil that is flowed through by an electrical current and which includes a pole core in its interior for focusing the magnetic field that is being generated. The magnetic field of one coil impacts plural, at least two permanent magnets which actuate actuation elements of an actuation unit. The actuation unit is an integral part of the actuator. Depending on a polarity of the permanent magnets and the polarity of the magnetic field generated in the coil the permanent magnets are attracted or repelled by the magnetic field of the coil. This way the permanent magnets are moved when the coil loaded with electrical current and the magnetic field is generated in the coil and thus the permanent magnets also actuate the actuation elements of the actuation unit. In a starting position the permanent magnets hold the actuation elements at the pole core through the magnet force. Additionally the actuation elements can be held in a starting position through an opposite force, for example a spring force. The retaining forces are overcome by the generated magnetic field when the coil is loaded with current before the permanent magnets come into motion due to the magnetic field. Through the movement of the actuation elements adjustment elements, for example at or in an internal combustion engine of a motor vehicle can be actuated. A mechanical reset is advantageous in particular when the permanent magnet forces are also used as retaining forces in an extended positon of the actuation elements.

The actuator can control two actuation elements independently from each other. The solution according to the invention requires few components for controlling two plungers. This saves installation space and weight since a respective set of the components coil, pole core and permanent magnet can be omitted and a small housing can be used.

When a failure occurs for example a short circuit it is not possible that both actuation elements of an actuator are actuated. In the prior art all actuator units in the housing and thus all plungers can be actuated simultaneously.

The controlled actuation element is selected according to an advantageous embodiment simply in that the coil includes a single winding and the permanent magnets are respectively controllable by reversing the polarity of the coil and loading it with electrical current.

According to alternative advantageous embodiment the selection is performed in that the coil includes two windings with different flow through directions on one coil body wherein a winding is respectively associated with a permanent magnet and the permanent magnets are respectively controllable by loading the associated winding with an electrical current.

A respective connection of the two coil windings facilitates that the two coil windings have different flow through directions when loaded with electrical current. Thus magnetic fields with different orientations are generated as a function of the winding that is flowed through with the electrical current and thus the same effect is obtained as during a polarity reversal of the coil. The two plus poles of the coil windings are connected to permanent plus and can be ideally connected to the same plug pin. The two other ends of the double winding are separately connected to ground through a respective switch. The respective coil winding can now be loaded with current through the respective switch.

Furthermore functionality is improved in that only one actuation element is actuatable at one time when the control or the current loading fails.

Energy consumption of the actuator according to the invention is low since there is less friction in the system and lower moving masses are provided due to the fact that only one permanent magnet segment is moved per actuation element. Thus furthermore higher accelerations and thus shorter switching times are facilitated.

Advantageously the actuation elements are configured as plungers. However also other shapes of actuation elements are conceivable according to the invention.

According to another advantageous embodiment also the actuation elements themselves can be magnetized or small permanent magnets approximately with a diameter of the actuation elements can be integrated in to the actuation element.

Advantageously the permanent magnets are arranged as ring magnets on a circumferential shoulder of the actuation elements and attached to the circumferential shoulder.

In order to provide an arrangement without losses the ring magnets are arranged respectively between two disc elements made from a magnetically conductive material and arranged at the shoulder wherein at least the disc element oriented towards the shoulder is attached at the actuation element. This yields a simple attachment of the magnets at the actuation elements.

When the permanent magnets are respectively enveloped by a magnetically nonconductive ring element which is attachable at the disc elements the permanent magnets are particularly insensitive to shock and damages with associated detrimental consequences can be excluded.

According to an advantageous embodiment the permanent magnets can be inserted into shoulders of the housing and can be respectively applied to the base of the shoulders. As stated supra the magnet force can then also be used as a support force in a deployed position of the respective actuation element and a bi-stable position is respectively achieved.

Advantageously the pole core is arranged within the coil and extends at an end that is associated with the actuation elements in an axial direction almost to an end of the coil, wherein the housing adjoins in the axial direction directly to the coil. Thus, a particularly high magnet force can be achieved since the magnetic field lines are introduced almost perpendicular to the axial direction from the pole core into the housing.

BRIEF DESCRPTION OF THE DRAWINGS

Additional advantages of the invention can be derived from the following drawing description. The drawings illustrate embodiments of the invention. The drawings, the description and the claims include multiple features in combination. A person skilled in the art will advantageously view the features individually and combine them into useful additional combinations, wherein:

DETAILED DESCRPTION OF THE INVENTION

Figure 1:
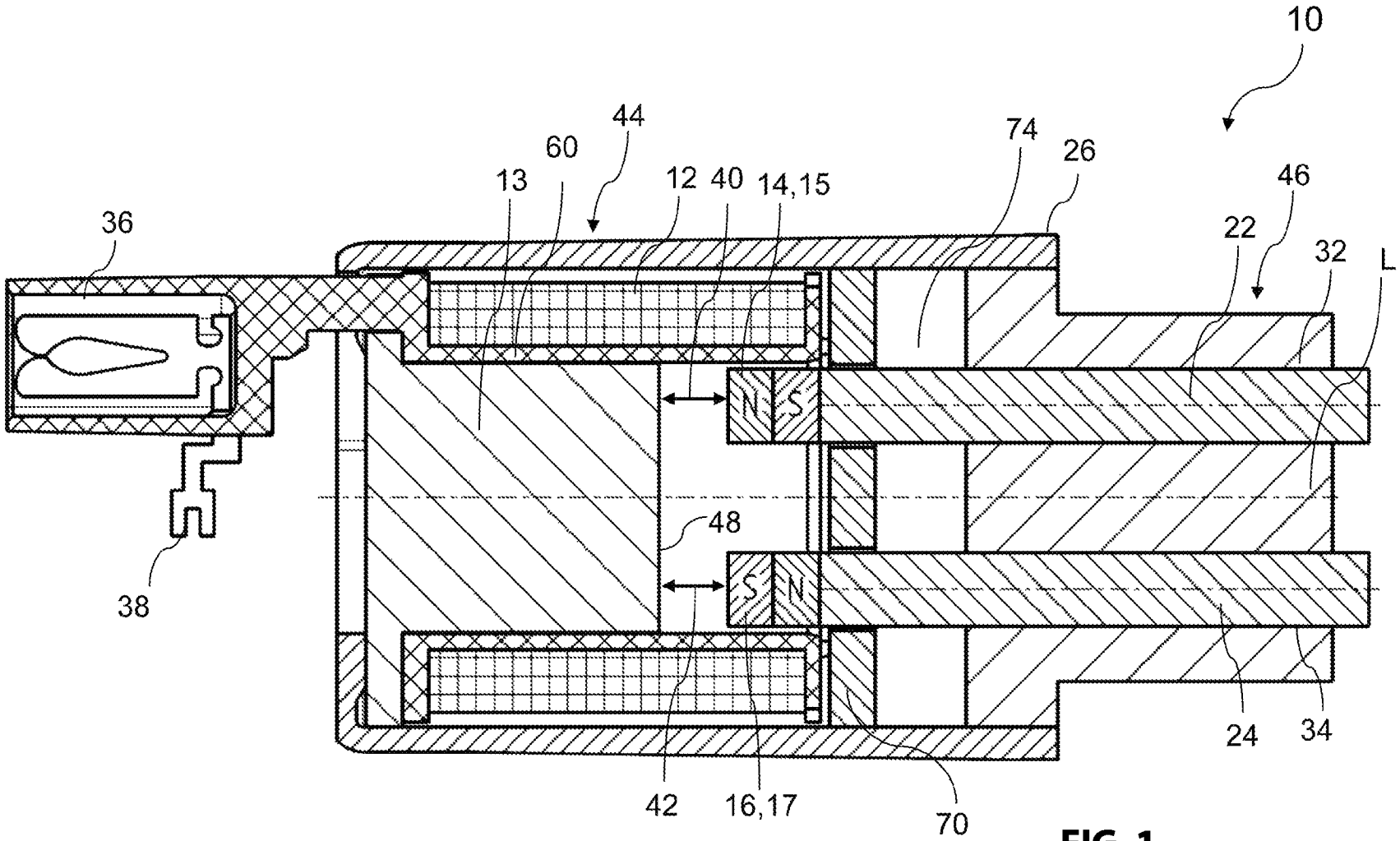
FIG. 1 illustrates a sectional view through a noncurrent loaded actuator according to an embodiment of the invention in which the permanent magnets are arranged at an end of the actuation elements within the coil.

In the drawing figures identical or like components are designated with identical reference numerals. The drawing figures merely illustrate exemplary embodiments and do not limit the scope and spirit of the invention.

FIG. 1 illustrates a sectional view of a noncurrent loaded actuator 10 according to a first embodiment of the invention. The electromagnetic actuator 10 includes an actuator unit 44 and an actuation unit 46 acting in an axial direction L. The actuator unit 44 includes a cylindrical coil 12 that generates a magnetic field and includes a pole core 13 that is arranged within the coil. Two actuator elements 14, 16 are arranged adjacent to a face 48 of the pole core 13 in an axial direction L, wherein an actuator element 14, 16 is respectively configured as a permanent magnet 15, 17 or as plural permanent magnet elements with identical polarity. The coil 12 drives both actuator elements 14, 16. The actuation unit 46 is arranged in the axial direction L adjacent to the actuator unit 44, wherein the actuation unit 46 includes two actuation elements configured as plungers 22, 24 which are supported in bore holes 32, 34 of the actuation unit 46 so that they are movable in the axial direction L. The plungers 22, 24 of the actuation unit 46 are respectively associated with one of the actuator elements 14, 16 and the respective actuator element 14, 16 actuates the associated plunger 22, 24 in the axial direction L. Based on the embodiment of the actuation elements 22, 24 as plungers the actuation unit 46 can also be designated as plunger unit. The shape of the actuation elements, however, is not limited to a plunger shape.

The actuator unit 44 and the plunger unit 46 are arranged in a common housing 26 of the actuator which helps to achieve a compact configuration of the actuator 10.

The coil 12 is a cylindrical annular coil. In a non-current loaded condition the coil 12 whose coil wires extend orthogonal to the drawing plane does not have a magnetic field. When the coil 12 is loaded with current through the connections 36, 38 a magnetic field builds up around the coil 12 wherein the field lines in turn extend perpendicular to the coil wires and thus extend in a sectional plane parallel to the drawing plane. The magnetic field is also effective at a location of the actuator elements 14, 16 and thus of the permanent magnets 15, 17. This causes an alternating effect with attraction or repulsion between the magnetic field of the coil 12 and the magnetic fields of the permanent magnets 15, 17 which causes a movement of the actuator elements 14, 16.

According to the first embodiment the actuation elements 22, 24 can be magnetized themselves or they can be provided as small permanent magnets 15, 17 approximately having a diameter of the actuation elements 22, 24 and can be provided integrated into the actuation element 22, 24. In order to reduce installation space the permanent magnets 15, 17 in this embodiment are arranged within the coil 12. The permanent magnets 15, 17 which represent the actuator elements 14, 16 are arranged at an end of the actuator elements 22, 24 and penetrate with the actuator elements 22, 24 into a portion in an interior of the coil 12. Thus, distances 40, 42 between the permanent magnets 15, 17 and the pole core 13 can thus be minimized when the permanent magnets 15, 17 contact the face 48 of the pole core 13.

When an electrical current is applied to the coil 12, one of the permanent magnets 15, 17 is repelled and the other one of the two permanent magnets 15, 17 is attracted as a function of the polarity of the current loading. This way the actuation elements 22, 24 in the actuation unit 46 are moved in the axial direction L by a back iron element 70 which is configured as a plate or disc made from magnetic material. In FIG. 1 the two permanent magnets 15, 17 are illustrated in a non-current loaded condition of the coil 12 at an average distance 40, 42 between permanent magnets 15, 17 and the face 48 of the pole core 13.

Since the actuation elements 22, 24 and the respective permanent magnet 15, 17 are arranged concentric a force impact upon the actuation elements 22, 24 is provided in a centric manner. Thus, an eccentrical loading and thus increased wear can be excluded without having to give up an installation space optimized actuator and a minimum axis offset of the actuation elements 22, 24. Expensive support measures to counter a tilting moment are not necessary either.

Figure 2:
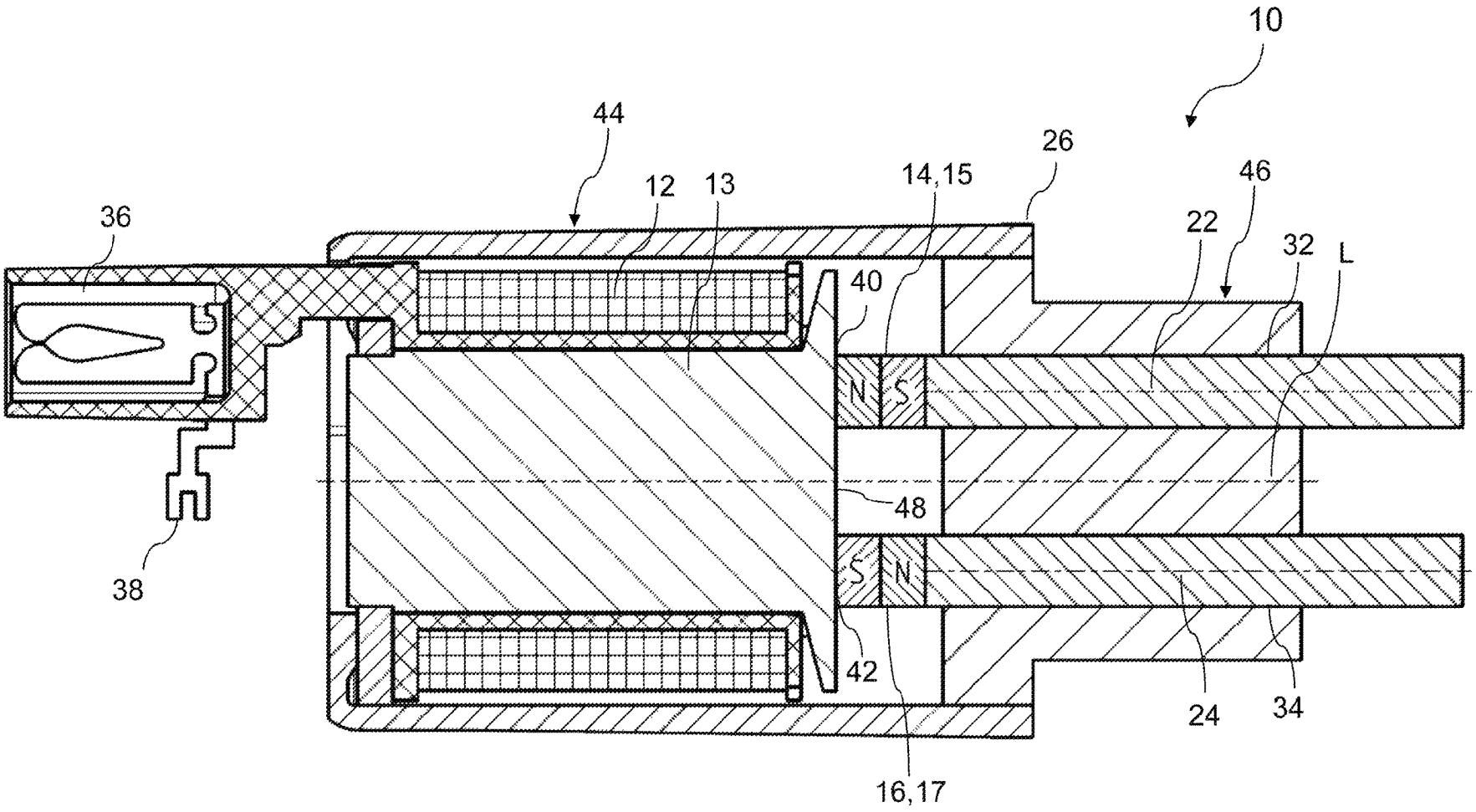
FIG. 2 illustrates a sectional view of a non-current loaded actuator according to another embodiment of the invention where the permanent magnets are arranged at an end of the actuation elements and contact the pole core at a face outside of the coil.

In a second embodiment that is illustrated in FIG. 2 the actuation elements 22, 24 are either magnetized themselves over a portion of their length or provided with small permanent magnets 15, 17 approximately having a diameter of the actuation elements 22, 24 and provided at an end of the actuation elements 22, 24. This embodiment represents a rather compact and cost effective embodiment of the actuation elements 22, 24 that is also used in the embodiment according to FIG. 1. As illustrated in FIG. 2, the permanent magnets 15, 17 however do not penetrate into an interior of the coil 12 since the interior is filled in this case with the pull core 13. A distance 40, 42 between the permanent magnets 15, 17 and the face 48 of the pole core 13 can only be reduced to zero so that the permanent magnet 15, 17 contact the pole core 13. When the coil 12 is loaded with electrical current one of the permanent magnets 15, 17 is repelled and the other of the two permanent magnets 15, 17 is attracted as a function of the polarity of the current loading. This way the actuation elements 22, 24 in the actuation unit 46 are subjected to an advantageous centric force introduction also in this embodiment and are moved in the axial direction L wherein this embodiment omits any additional support of the actuation elements 22, 24 besides the bore hole 32, 34 of the actuation unit 46. In FIG. 2 the permanent magnets 15, 17 are illustrated in a non-current loaded condition of the coil 12 at a distance 40, 42 between the permanent magnets 15, 17 and the face 48 of the pole core 13 that is zero since the permanent magnets 15, 17 are attracted by the pole core 13 which can be made for example from steel in a non-current loaded condition of the actuator unit.

Figure 3:
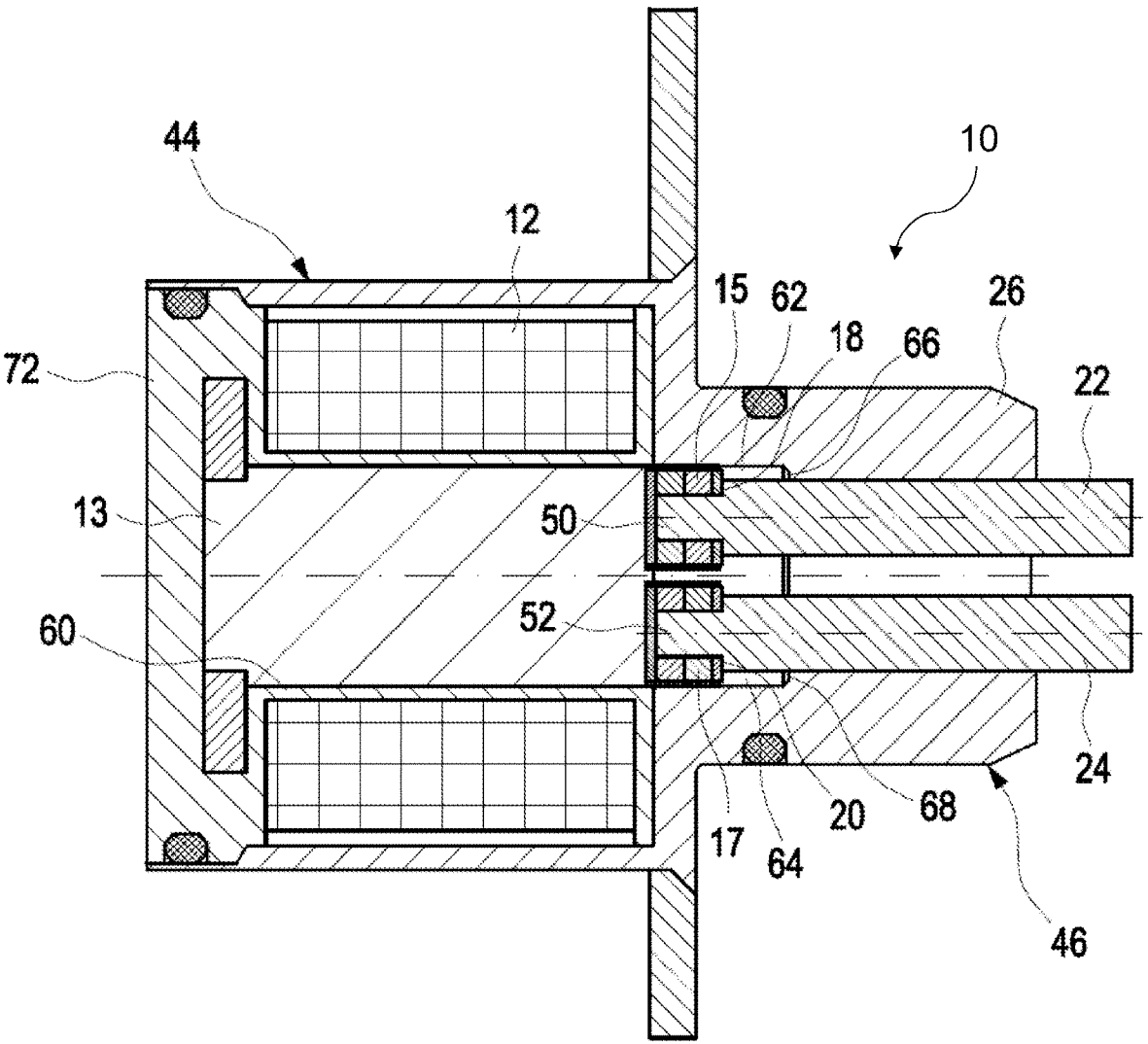
FIG. 3 illustrates a sectional view of a non-current loaded actuator according to another embodiment of the invention in a starting position.
Figure 4:
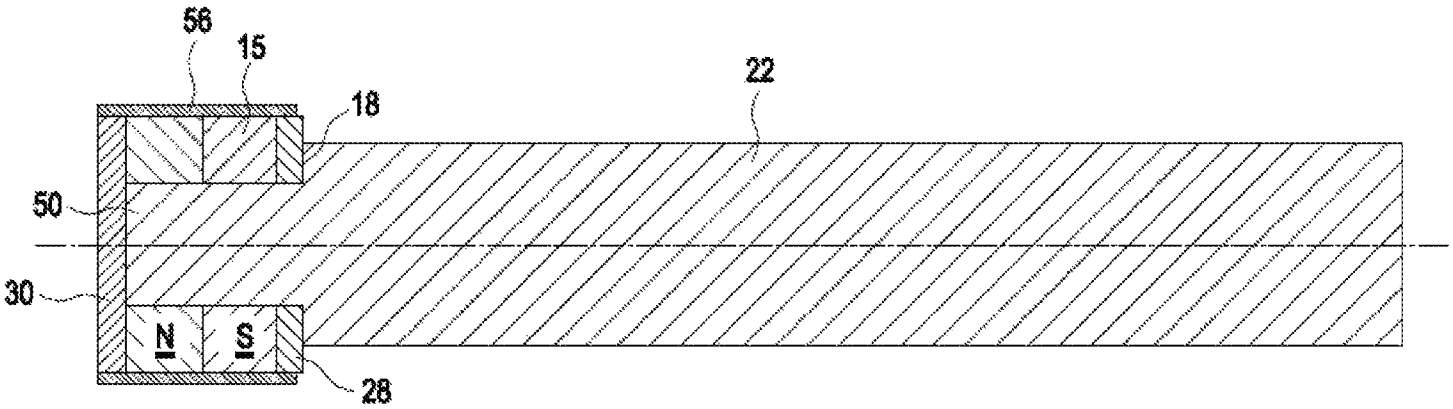
FIG. 4 illustrates a sectional view of an actuation element of the actuator according to FIG. 3.

FIG. 3 illustrates a sectional view of a third embodiment. Differently from the two embodiments described supra the permanent magnets 15, 17 are thus arranged as ring magnets on a circumferential shoulder 18, 20 of the actuation elements 22, 24 and attached at the circumferential shoulder. The actuation element 22 is illustrated in FIG. 4 in a blown up sectional view. The actuation element 24 is configured with identical configuration, wherein as described supra the polarity of the permanent magnet 17 is reversed.

It is evident that the ring magnet 15 is arranged between two disc elements 28, 30 on the shoulder 18 that are made from a magnetically conductive material, 20. The disc element oriented towards the shoulder 18 is thus provided ring shaped and is centered by a centrally arranged protrusion 50 like the permanent magnet 15 and attached at the actuation element 22, for example by laser welding or gluing.

When the permanent magnets 15, 17 are respectively enveloped by a magnetically non-conductive ring element 56, 58 they are protected particularly well by this encapsulation against shock and damages with the associated detrimental consequences can be excluded. Also the ring element 56, 58 can be attached at the disc elements 28, 30 in a simple and secure manner by laser welding or gluing.

Overall this yields simple a safe attachment of the magnets 15, 17 at the actuation elements 22, 24.

In this embodiment the pole core 13 is exclusively arranged within the coil 12 or its coil body 60 and extends with its end associated with the actuation elements 22, 24 in the axial direction almost to an end of the coil 12. Thus, the housing 26 directly adjoins in the axial direction to the coil 12 or the coil body 60 so that a particularly strong magnetic force can be obtained since the magnet field lines are introduced from the pole core 13 into the housing 26 approximately perpendicular to the axial direction L. Thus, the arrangement of the pole core 13 relative to the housing 26 is essential since an air gap between the pole core 13 and the housing 26 has very strong influence upon a force level of the actuator 10.

As can be further derived from FIG. 3 the housing 26 is configured in one piece in the portion of the actuation unit 46 and additionally envelops the coil 12 at its outside. The coil element 60 forms a base 72 at an end that is oriented away from the actuation unit 46 wherein the base 72 is connected at and sealed relative to the housing 26.

The permanent magnets 15, 17 are furthermore insertable into shoulders 62, 64 of the housing 26 and respectively applicable to a base 66, 68 of the shoulders 62, 64. Thus, the magnetic force can be used as a retaining force also in an extended position of the respective actuation element 22, 24 and a bi-stable position is obtained respectively.

The actuation elements 22, 24 are rotatably arranged in the housing 26, so that wear for example during rolling in engagement grooves can be minimized. As a matter of principle the invention is not limited to two actuation elements. Thus, also an arrangement of more than two actuation elements for example four or six actuation elements is conceivable.

The controlled actuation element 22, 24 is selected as described supra in a simple manner in that the coil 12 includes a single winding and the permanent magnets 15, 17 are respectively controllable by polarity reversal and electrical current loading of the coil 12.

Alternatively the coil 12 on the coil body 60 can also have two windings with different flow through directions so that the magnetic field is respectively established in a different direction. Thus, different effects are imparted upon the permanent magnets 15, 17 so that the permanent magnets 15, 17 are respectively actuatable by loading the associated winding with the electrical current.

Additional variations of the invention through combinations of the recited features are conceivable but not illustrated in detail.

REFERENCE NUMERALS AND DESIGNATIONS

10 actuator
12 Cell
13 pole core
14 actuator element
15 permanent magnet
16 actuator element
17 permanent magnet
18 shoulder
20 shoulder
22 actuation element
24 actuation element
26 housing
28 disc element
30 disc element
32 bore hole plunger
34 bore hole plunger
36 connection coil
38 connection coil
40 distance actuator element-pole core
42 distance actuator element-pole core
44 actuator unit
46 actuation unit
48 face of pole core
50 protrusion
54 protrusion
56 ring element
58 ring element
60 coil body
70 back iron element
72 base

What is claimed is:

1. An electromagnetic actuator, comprising:

an actuator unit; and an actuation unit acting in an axial direction, wherein the actuator unit includes a single coil generating a magnetic field and including a pole core that is arranged within the single coil, wherein at least two permanent magnets are arranged adjoining a face of the pole core in the axial direction so that the at least two permanent magnets are applicable to the face of the pole core and movable in the axial direction so that the at least two permanent magnets are drivable by the single coil independently from each other, wherein the at least two permanent magnets have different polarity in the axial direction and are respectively controllable by loading the single coil with an electrical current so that at least one of the at least two permanent magnets moves in the axial direction in an opposite direction to another of the at least two permanent magnets when the single coil is loaded with the electrical current, wherein the actuation unit is arranged in the axial direction adjacent to the actuator unit wherein the actuation unit includes at least two actuation elements which are actuatable in the axial direction, wherein each actuation element of the actuation unit is respectively fixed in the axial direction at one of the at least two permanent magnets and moved together with the one permanent magnet in the axial direction, wherein the actuator unit and the actuation unit are arranged in a common housing of the electromagnetic actuator, wherein the at least two actuation elements and the at least two permanent magnets are arranged so that each respective permanent magnet of the at least two permanent magnets is arranged concentrically relative to a respective actuation element of the at least two actuation elements so that an entire a force impact from the at least two permanent magnets upon the at least two actuation elements is provided in a centric manner relative to the respective actuation element, wherein the at least two actuation elements are rotatably arranged in the common housing, and wherein an entire force generated by the magnetic field of the single coil that moves either one of the at least two permanent magnets is transferable by the at least two actuation elements to an external component to be actuated.

2. The actuator according to claim 1, wherein the single coil includes a single winding and the at least two permanent magnets are respectively controllable by polarity reversal and electrical current loading of the single coil.

3. The actuator according to claim 1, wherein the single coil includes two windings with different flow through directions on a coil body, and wherein one winding of the two windings is respectively associated with one permanent magnet of the at least two permanent magnets and the at least two permanent magnets are respectively controllable by loading an associated winding with the electrical current.

4. The actuator according to claim 1, wherein the at least two actuation elements are magnetized.

5. The actuator according to claim 1, wherein the at least two permanent magnets are respectively integrated in the at least two actuation elements.

6. The actuator according to claim 1, wherein the at least two permanent magnets respectively are provided as a ring magnet on a circumferential shoulder of one actuation element of the at least two actuation elements and respectively attached to the circumferential shoulder.

7. The actuator according to claim 6, wherein the ring magnet is arranged on the circumferential shoulder between two disc elements made from a magnetically conductive material, and wherein at least one disc element of the two disc elements that is oriented towards the shoulder is attached at the one actuation element.

8. The actuator according to patent claim 7, wherein the at least two permanent magnets are respectively enveloped by a ring element that is not magnetically conductive wherein the ring element is attachable at the two disc elements.

9. The actuator according to claim 6, wherein the at least two permanent magnets are insertable into shoulders of the common housing and respectively applicable to a base of the shoulders of the common housing.

10. The actuator according to claim 6, wherein the pole core arranged within single the coil and extends in the axial direction at an end associated with the at least two actuation elements substantially to but not completely to an end of the single coil, and wherein the common housing adjoins directly to the single coil in the axial direction.

11. The actuator according to claim 1, wherein the at least two permanent magnets hold the at least two actuation elements at the pole core through the magnet force when in a starting position.

12. The actuator according to claim 1, wherein the at least two actuation elements are configured as plungers.

* * * * *